US009788569B2

(12) United States Patent
Cooper

(10) Patent No.: US 9,788,569 B2
(45) Date of Patent: Oct. 17, 2017

(54) CIGAR FLAVORING METHOD

(76) Inventor: Jack B. Cooper, Palos Hills, IL (US)

( * ) Notice: Subject to any disclaimer, the term of this patent is extended or adjusted under 35 U.S.C. 154(b) by 1490 days.

(21) Appl. No.: 12/477,402

(22) Filed: Jun. 3, 2009

(65) Prior Publication Data

US 2009/0235942 A1 Sep. 24, 2009

Related U.S. Application Data

(63) Continuation-in-part of application No. 11/705,365, filed on Feb. 8, 2007, now Pat. No. 8,015,979.

(51) Int. Cl.
*A24C 1/38* (2006.01)
*A24C 5/60* (2006.01)

(52) U.S. Cl.
CPC ..... *A24C 1/38* (2013.01); *A24C 1/386* (2013.01); *A24C 5/606* (2013.01); *A24C 5/607* (2013.01); *A24C 5/608* (2013.01)

(58) Field of Classification Search
USPC ..... 131/252, 280, 300, 360, 362–363
See application file for complete search history.

(56) References Cited

U.S. PATENT DOCUMENTS

| | | | | |
|---|---|---|---|---|
| 1,437,956 | A | 12/1922 | Blair | |
| 1,778,482 | A * | 10/1930 | Burns | 131/77 |
| 1,892,402 | A | 5/1931 | Lankering | |
| 1,892,429 | A | 12/1931 | Frankel | |
| 2,007,632 | A * | 7/1935 | Blank et al. | 312/31 |
| 2,333,049 | A * | 10/1943 | Shapiro | 131/300 |
| 3,732,872 | A * | 5/1973 | Lakritz | 131/300 |
| 4,233,995 | A * | 11/1980 | Kotuby et al. | 131/300 |
| 4,733,674 | A | 3/1988 | Sielck et al. | |
| 5,615,694 | A | 4/1997 | Battard et al. | |
| 6,053,175 | A * | 4/2000 | D'Angelo | 131/300 |
| 6,055,991 | A | 5/2000 | Benjoseph et al. | |
| 2002/0166561 | A1* | 11/2002 | Sinclair, Jr. | 131/73 |
| 2004/0182405 | A1* | 9/2004 | Grzonka et al. | 131/309 |
| 2006/0000481 | A1* | 1/2006 | Sinclair, Jr. | 131/347 |

* cited by examiner

*Primary Examiner* — Jodi C Franklin
(74) *Attorney, Agent, or Firm* — Fishman & Associates, LLC.

(57) ABSTRACT

A novel cigar is provided with an elongated cigar puller device which extends into the interior of the cigar. By removing the cigar puller from the cigar, the tobacco fill material of the cigar is disrupted so as to improve the draw of the cigar. Once the cigar puller is removed from the tobacco fill material, a flavorant and/or aromatic can be infused into the less dense tobacco fill material which is provided upon the removal of the cigar puller.

10 Claims, 7 Drawing Sheets

CIGAR FLAVORING METHOD

This application is a Continuation-In-Part of U.S. application Ser. No. 11/705,365, filed Feb. 8, 2007.

FIELD OF THE INVENTION

The present invention is directed to a novel cigar that has improved draw and/or added flavor.

BACKGROUND OF THE INVENTION

In recent years, smoking of cigars has become in vogue, and numerous cigar shops have opened around the world to satisfy this growing trend. The variety, quality and size of ready-made cigars satisfy the majority of the public.

The tobacco industry provides a number of products. Some products, like cigarettes and pipes, use relatively finely and or uniformly ground tobacco. When tobacco is cut in this manner, the tobacco provides a relatively consistent draw which allows each cigarette or pipe to draw in the same manner for each smoke.

Cigars, on the other hand, are manufactured in a variety of ways. They may be made by machine, or in the case of more expensive brands, they may also be made by hand. The size and shape of the pieces of tobacco in a cigar will also vary. It is this variation in the tobacco filler used to manufacture cigars that causes irregularities in drawing performance and may even cause failure of the cigar to draw at all. Cigars that draw poorly or do not draw at all are often discarded by the smoker, or returned to the manufacturer for a refund. Since cigars may be relatively expensive, the problems caused by drawing failure will create either an unnecessary expense to the smoker, or lost profits to the manufacturer who accepts return of the defective cigars.

The drawing problems are usually caused by the tobacco fill material. Sometimes the tobacco fragments in the fill material in a cigar can be substantially large. They may block a portion of the air passage through which smoke passes, and may even block the air passage entirely if the fragment is large enough. When this happens, the cigar is unusable or usable only with difficulty.

This undesired side effect of the manufacturing techniques used to manufacture cigars, namely the unevenness of drawing smoke through the cigar, results in a situation where the same box of cigars may contain several cigars that draw in an easy and desirable fashion, some that draw with some difficulty, and some that may not draw at all. This leads to a situation where the smoker may be inconvenienced and the manufacturer may lose future sales or incur losses due to returns. It would be desirable to provide a method of increasing the drawing capability of a cigar, when necessary, such that heretofore unusable cigars could be enjoyed by a smoker.

An associated manufacturing problem is the reduction in drawing capability of a cigar due to the filler tobacco in the cigar being too tightly packed during the bunching or manufacturing process. In this situation, there may not be any overly large fragments of tobacco fill, but the limited open space due to the tight packing is such that airflow through the cigar is restricted. Smokers will have the same difficulty in drawing smoke through a tightly packed cigar as they had in the foregoing situation where the tobacco fragments acted as barriers. Another possible draw restriction could be due to overly moist tobacco which is caused storing the tobacco in improper humidity. In like fashion, it would be desirable to provide a method of increasing the drawing capability of a tightly packed cigar, or a cigar with overly moist tobacco, when necessary, such that the heretofore unusable cigar could be enjoyed by a smoker.

In the past, the smoker's only recourse was to either throw away the cigar entirely, or to cut off segments of the cigar until a portion that was usable was reached. This may result in only a small portion of the cigar that is available for use. Further, if more than one blockage exists in the cigar, then cutting off segments of the cigar may not effect the drawing capability of the cigar. As a result, a smoker has limited recourse when trying to smoke a poorly drawing cigar.

U.S. Pat. Nos. 4,733,674 and 6,055,991 are directed to punch-type devices that can be pushed into the cigar to improve ventilation or draw of the cigar. Besides adding to the expense of cigar smoking, the need to manipulate the patented devices to achieve the desired punch and improve the draw infringes on the enjoyment of the smoking process. Additionally, manipulation of the punch device may possibly cause minor injury to hands or fingers.

In attempts to improve the smoking experience, various methods for altering the aroma or flavoring of the smoking articles have been proposed. Frequently, the cut filler (the shreds of strands of tobacco material) is treated with volatile additives such as top dressing or flavors in the form of an alcoholic solution. Casing materials, having a relatively low degree of volatility such as sugars, licorice, cocoa, essential oils, fruit extracts and humectants, are applied to the tobacco by dipping or spraying prior to the cutting or shredding operation. While these methods effectively provide an alteration in flavor and aroma of the smoking material upon burning during use due to the intimate contact in which the flavorant is applied to the tobacco, these methods must take place prior to the actual formation of the finished product. That is, a predetermined amount of tobacco and cut filler must be treated prior to the formation of the cigars which contain the treated tobacco in order for the cigar to contain the desired aroma. The aromatized tobacco cannot be tested until the smoking article is formed, and it is sometimes difficult to know how much tobacco to treat to form a desired number of smoking articles.

U.S. Pat. No. 5,615,694 to Battard et al discloses a method for aromatizing the smoke of smoking articles by applying to its wrapper a solution of aromatizing substance which is transferred to the smoking article in vapor phase in the confined atmosphere of the packing of the smoking article. U.S. Pat. No. 2,007,632 to Blank et al discloses the use of flavor impregnated sticks to impart flavor to cigarettes which are dispersed within a package containing the cigarettes.

Cigars have been consumed much longer than cigarettes. In fact, it wasn't until the late 1700's that Cuban cigar makers made "little cigars", i.e. "cigarettes" using paper wrappers derived from cotton. Just recently however, as cigarette smoking has been decreasing in popularity and acceptance due to health risks, cigar smoking has been gaining in popularity with both men and women. Although the methods described by Battard et al and Blank et al may be used for treating finished tobacco products, they are directed primarily towards cigarette preparation, and therefore alternate methods for smoking article preparation particularly addressing the desires of cigar smokers is in need.

SUMMARY OF THE INVENTION

A novel cigar is provided in which a means for improving the draw of the cigar is incorporated in the cigar during the manufacturing process. As disclosed, an elongated cigar puller device is incorporated within the tobacco during the manufacture of the cigar and can be pulled from the cigar so as to disrupt a portion of the tobacco fill and improve the draw of the cigar during smoking. To further enjoy the smoking experience, a cigar puller is incorporated into the cigar during the manufacturing process and can be used to infuse flavorants and/or aromatics into the cigar prior to being pulled from the cigar. The cigar infusers allow for the individual user to provide flavoring or aromas to the cigar which are pleasing to individual taste.

DETAILED DESCRIPTION OF THE INVENTION

Prior to a detailed discussion of the figures, a general discussion of the features and advantages of the invention will be presented. As discussed above, cigar smokers often are inconvenienced by the inability of a cigar to draw. This is often caused by a blockage inside the cigar by a large fragment of fill tobacco, or by the cigar being too tightly packed. Many cigars are discarded for this reason. Unfortunately, since cigars can be relatively expensive, this results in a waste of the smoker's money, or a loss of profit to the manufacturer if the cigars are returned.

A portion of some of these non-drawing cigars can be salvaged. This is accomplished by progressively cutting off portions of the cigar until a segment is reached that adequately draws. Depending on the location of the fill fragment that is preventing the cigar from drawing, this may result in only a small portion of the cigar being usable. In the case of tightly wound cigars, cutting off segments of the cigar may have no effect.

The invention eliminates drawing problems by opening an air passage through the length of the cigar such that the entire cigar is usable. In accordance with the present invention the draw or ventilation of a cigar is provided by incorporating into the cigar during the manufacturing process, an elongated cigar pulling device which extends from one end of the cigar toward the other end and can be pulled from the cigar so as to disrupt the tobacco and, in particular, disrupt any large tobacco fragments or tightly packed tobacco fill material which can block a portion of the air passage through which the smoke passes. The elongated cigar puller can extend from any end of the cigar toward the other, can have various types of variegated surfaces to promote disruption of the tobacco fill material and can be of various sizes extending from the full length of the cigar to sizes which do not extend through the full length of the cigar. In other embodiments of this invention, the cigar puller can also be a cigar infuser in which the cigar puller can be used to direct flavorants or aromatic materials into the interior of the cigar to allow the individual smoker to alter the taste of the cigar and/or provide an alternative aroma to the smoke to enhance the individual smoking experience.

Figure 1:
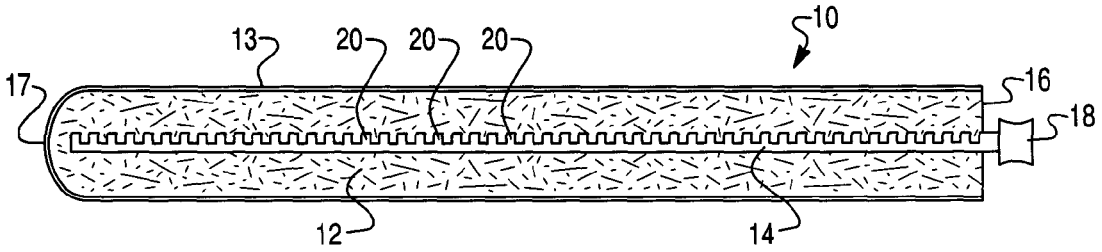
FIG. 1 is a longitudinal cross section of the novel cigar of this invention showing one embodiment of a cigar puller therein.
Figure 2:
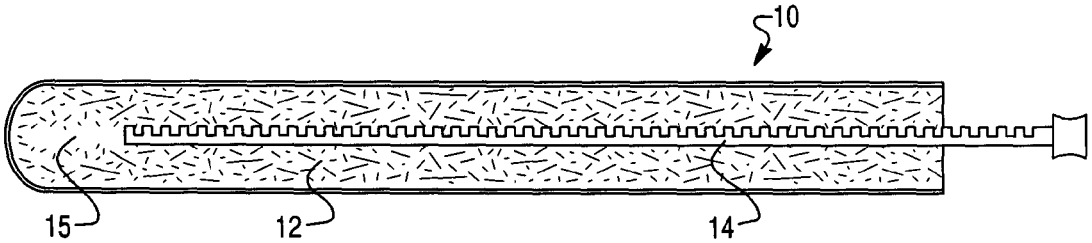
FIG. 2 is a cross section of the cigar of FIG. 1 showing the initiation of the cigar puller being removed from the cigar and the disruption of the tobacco within the cigar.

Referring to FIGS. 1 and 2, an example of a novel cigar of the present invention is indicated by reference numeral 10. The cigar 10 includes a tobacco fill material 12 wrapped within a casing 13 typically of tobacco or other natural vegetable product. Included as part of cigar 10, is an elongated cigar puller 14 which in the embodiment of FIG. 1 extends from end 16 of cigar 10 to or almost to the opposite end 17 of cigar 10. Although not shown, cigar puller 14 may extend beyond end 17. Extending outside of the cigar 10 and either permanently attached to cigar puller 14 or removeably attached thereto is a pull tab 18 which can be grabbed by the user such as between a thumb and a finger and the cigar puller 14 removed from cigar 10 as shown in FIG. 2. As shown in FIG. 2, as the cigar puller 14 is pulled out of the cigar, the tobacco fill material in the path of the cigar puller is disrupted to a certain extent so as to chop any large tobacco pieces or loosen any packed fill material to produce an area of less fill density as indicated by reference numeral 15. The less dense path of fill material improves the draw of the smoke through the cigar.

The elongated portion of the cigar puller 14 will have a variegated surface so as to enhance the disruption of the tobacco fill material as it is being pulled through the cigar. The exact nature of the variegated surface is not critical and any and all types of surface variations can be utilized. As shown in FIGS. 1 and 2, a square saw-tooth type of configuration is shown in which a series of spaced teeth 20 enhance the disruption and/or chopping of the tobacco to remove large and/or tightly packed fill fragments. The width of the cigar puller 14 which extends into the cigar should be wide enough to disrupt the tobacco fill material to improve the draw of the cigar but not so wide so as to be difficult to pull and grossly disrupt the packing of the tobacco fill material of the cigar. In general, the width of the cigar puller 14 should be less than half of the width of the cigar, typically less than a ⅓ of the width of the cigar and more typically, will be less than ¼ of the width of the cigar.

The cigar puller of this invention such as cigar puller 14 as shown in FIGS. 1 and 2, can be formed of any material which is strong enough to handle the manufacturing process and be able to be pulled from the cigar to disrupt the tobacco fill material without itself being torn or broken so as to leave pieces of the puller within the cigar. Thus, for example, the cigar puller of this invention can be formed of plastic, wood, metal, reinforced paper, cardboard, synthetic or natural fiber, and composites of any and all such materials. To form the variegated surface of the cigar puller, the material which forms the cigar puller can be molded, stamped, cut, etc. Any known shaping process capable of achieving the variegated surface can be used. Composite cigar pullers can be formed by coating an elongated rod with materials which will form a rough surface capable of disrupting the tobacco fill material. For example, pipe cleaner devices in which a stiff wire is coated with synthetic or natural fibers would be an example of a composite type cigar puller device. Powder coating a surface with a non-uniform coating is yet another example of a composite cigar puller. It is further important that the material which forms the cigar puller or any coating thereon does not adversely affect the tobacco fill material during the storage of the cigar. It would be preferred that the material which forms the cigar puller be inert or unreactive to the tobacco fill to avoid any reactions which could adversely effect the taste and aroma of the cigar.

The cigar puller of this invention is incorporated into the cigar during the manufacturing process. Thus, in a typical cigar manufacturing process large tobacco leaf material is laid out and the tobacco fill material is then applied on the leaf. At this point, the cigar puller of the invention is placed on the tobacco fill material and additional fill material is then applied. The cigar is then rolled with the layout leaf typically forming the wrap. The invention is intended to distinguish over means external of the cigar which can be poked or punched into the cigar after the cigar has been formed.

An important feature of the present invention is the pull tab 18 which is secured to the elongated portion of cigar puller 14. The tab 18 can be permanently attached to the elongated portion such as by being integrally molded or otherwise shaped therewith or can be separate but permanently attached by some type of permanent adhesive and the like. It may also be useful to removeably attach pull tab 18 to the cigar puller 14. Attachment by screw-threads or any type of snap fit attachment can be used. The shape of pull tab 18 can be of an infinite variety and it may provide a collector's item, per se. The pull tab 18 can be formed of any material effective for the cigar puller. The shape of pull tab 18 can be provided so as to add an aesthetic appeal to the cigar puller 14. For example, see pull tab 19 in FIG. 3 and pull tab 33 in FIG. 6 as non-limiting examples of pull tab shapes. Pull tab 19 may even be provided with indicia 22 so as to provide advertising to enhance marketing of a product or can be provided with any type of words or phrases, again to enhance the novelty of cigar 10. For example, indicia to the sex of a newborn baby is but one of the infinite examples of phrases that can be placed on pull tab 19. The indicia 22 can be applied by printing or coating with a dye, ink, pigment, or any other type of coating material. The indicia can be provided by decal which can be adhered such as by an adhesive to the surface of pull tab 19. Additionally, the indicia can be stamped or embossed into the surface of pull tab 19. The indicia 22 which can be included into or on the surface of pull tab 19 is unlimited and any and all type of means to provide a marking on the surface of pull tab 19 can be utilized to enhance the aesthetics of cigar 10 or, as again stated, provide for marketing or for any type of written or pictorial expression.

Figure 3:
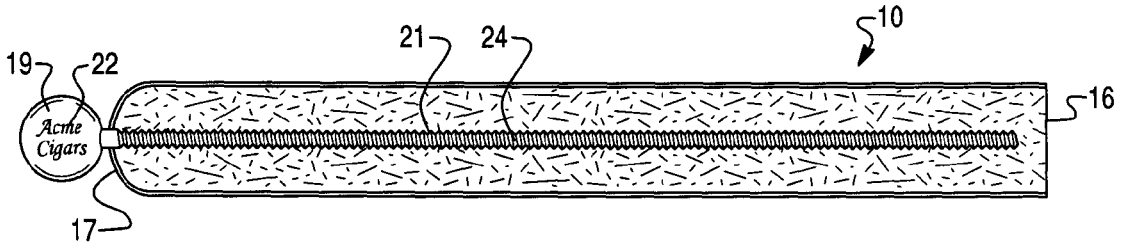
FIG. 3 is a longitudinal cross section of a novel cigar of the present invention illustrating the incorporation of a cigar puller which is pulled from the opposite end of the cigar than the cigar pullers of FIGS. 1 and 2.

Again referring to FIG. 3, it can be seen that cigar puller 21 extends in this instance from the end 17 toward the end 16 of cigar 10. Typically, end 16 will be where the cigar is initially lit. Similar to cigar 10 illustrated in FIGS. 1 and 2, the cigar puller 21 extends substantially through the full length of the cigar 10 from end 17 to about end 16. The variegated surface of the elongated portion of cigar puller 21 in the embodiment shown in FIG. 3 is that of a screw type thread indicated by reference numeral 24.

Figure 4:
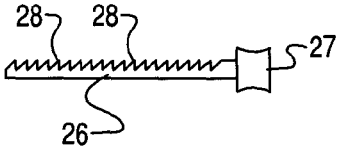
FIG. 4 is a plan view of a cigar puller useful in this invention indicating that the cigar puller can be of varying size, e.g. approximating one quarter the length of the cigar.
Figure 5:
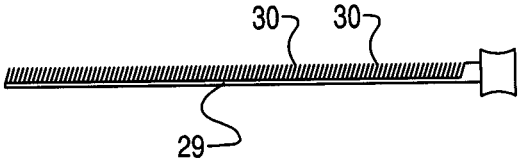
FIG. 5 is a plan view of another type of cigar puller of this invention showing that the size can be approximately one half the total length of the cigar.
Figure 6:
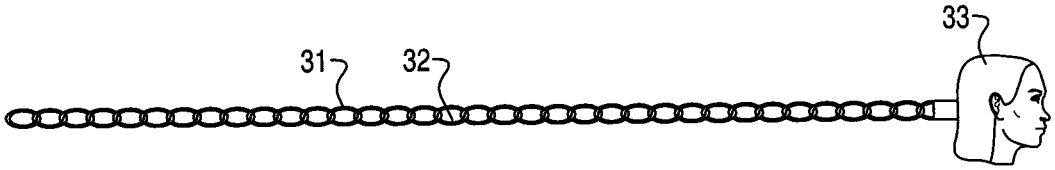
FIG. 6 is a plan view of an alternative embodiment of a cigar puller of this invention showing a chain linked typed device.

FIG. 4 depicts another example of a cigar puller of this invention. Thus, in this instance, the cigar puller 26 is significantly smaller than the cigar pullers 14 and 21 shown in FIGS. 1-3. In this instance, the cigar puller 26 will extend from either end of the cigar to approximately about ¼ the length of the cigar from the end through which the pull tab 27 extends. Thus, in finely manufactured cigars, there may not be a need for a cigar puller that extends the full length of the cigar and only a small portion of the tobacco may need to be disrupted to improve draw. Further, the variegated surface of cigar puller 26 in the embodiment shown in FIG. 4 is a series of saw teeth 28 which are used to disrupt the tobacco fill material. Likewise, FIG. 5 illustrates still another unlimiting embodiment of the cigar puller of this invention. In FIG. 5, the cigar puller 29 has a length that will extend at least about half way along the length of the cigar from one end thereof. In still another embodiment of this invention, the variegated surface of cigar puller 29 is composed of a series of elongated and thin comb teeth 30. Again, it is to be understood that the cigar puller of this invention is not limited to the specific type of variegated surface which can be provided. Any and all types of surfaces which are roughened and not uniform can be utilized to disrupt large leafs or the pockets of tightly bound fill material which may adversely effect the ventilation and draw of smoke through the cigar. FIG. 6 is still yet another example of a type of non-uniform surface which can be provided in which the cigar puller 31 is formed by a series of links 32 to from a chain which provides a non-uniform surface throughout the length of the cigar puller 31. While cigar pullers with non-uniform surfaces are preferred, an elongated puller device having a smooth surface is also part of this invention. Thus, any friction between the puller and the tobacco fill material may effect the density of the fill material as the puller is withdrawn from the cigar.

Figure 7:
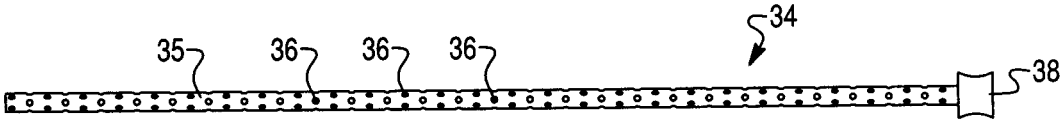
FIG. 7 is a plan view of another embodiment of a cigar puller of this invention in which the cigar puller can be used to infuse flavorants or aromatics to alter the taste and aroma of the cigar.
Figure 8:
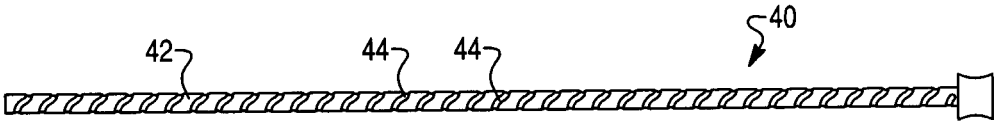
FIG. 8 is a plan view of still another embodiment of a cigar puller of this intention which can also be used to infuse flavorants and/or aromatics into the cigar.

Referring to FIGS. 7 and 8, alternative cigar pulling devices are disclosed in which each of the devices can also be characterized as a cigar infuser in which the elongated pullers can be used to infuse the interior of the cigar with flavorants and/or aromatic compounds which can alter the aroma of the cigar smoke. In FIG. 7, cigar puller 34 comprises a hollow tube 35 containing a plurality of holes 36 extending around the width and along the length of tube 35. Cigar puller 34 also includes a pull tab 38 which allows the cigar puller 34 to be withdrawn from the cigar to improve the draw and ventilate the cigar. In FIG. 8, a cigar puller 40 is shown comprising an elongated rod 42 containing an external spiral groove 44 extending the length of the cigar puller 40. Again, the cigar puller 40 can include a pull tab 46 to allow the user easy access to pull the cigar puller 42 through the tobacco and improve the draw of air/smoke there through. Both cigar pullers 34 and 40 have a variegated surface, whether the spaced holes 36 of cigar puller 34 or the spiral groove 44 of puller 40, so as to provide disruption of the tobacco as the puller is pulled through and from the cigar.

Figure 9:
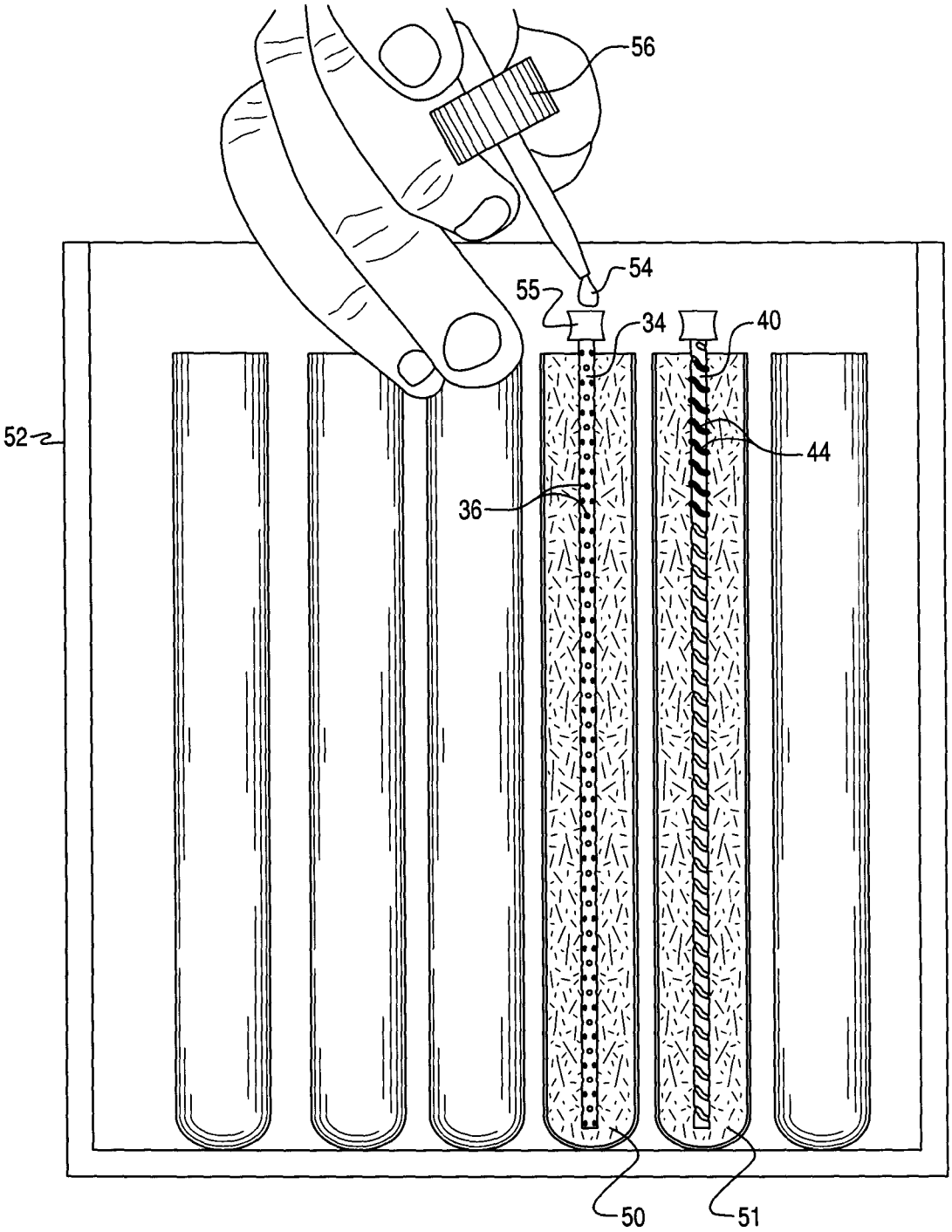
FIG. 9 is a drawing partly in cross-section of illustrating the infusion of flavorants and/or aromatics into the cigar using the cigar pullers/infusers of FIGS. 7 and 8.

FIG. 9 illustrates how each of the cigar pullers 34 and 40 can act as cigar infusers to incorporate flavorant and/or aromatic chemicals into the interior of the cigar.

The method by which the cigars are infused with the flavorant and/or aromatic chemicals is shown in FIG. 9. Typically the cigars 50 and 51 are vertically stored in a device 52 which maintains the proper humidity of the surrounding environment within which the cigars are placed so that the cigars can remain fresh during storage. As shown, cigar 50 contains cigar puller 34 whereas cigar 51 contains cigar puller 40. Cigar puller 34 is hollow and as shown in FIG. 9, pull tab 55 is also hollow such that a liquid containing a flavorant and/or aromatic compound effective to alter the aroma of the cigar can be applied into the interior of cigar puller 34 such as by means of a dropper device 56. The liquid 54 enters the interior of cigar puller 34, and, in particular, the hollow elongated portion of puller 34 and is drawn by gravity down through the length of cigar puller 34 and dispensed out either in liquid form or in vapor form through the holes 36 contained within the elongated portion of puller 34. The intensity of the flavoring or aroma-altering process can be controlled by the user by a systematic incorporation of the liquid 54 into the hollow portion of cigar puller 34. Thus, the incorporation of a desired amount of liquid and the like into the interior of puller 34 can be repeated any number of times to provide the desired taste or aroma. Once the desired amount of flavorant and/or aromatic is incorporated into the cigar, the cigar can then be smoked where upon the cigar puller 34 is removed from the cigar by the pull tab 55. Accordingly, not only has the cigar 50 been infused with the desired flavorant and/or aromatic, but the ventilation properties of cigar 50 are also improved. Although FIG. 9 illustrates the incorporation of the flavorant and/or aromatic as a liquid into the hollow cigar puller 34, it is within the scope of this invention that the additives can be infused into the cigar as a solid such as a fine powder or even as a vapor which is blown through the hollow interior of cigar puller 34. Even as a fine powder or vapor, the flavorant and/or aromatic will be dispensed throughout the length of cigar puller 34 via the holes 36 contained along the length of cigar puller 34.

Similarly, cigar puller 40 can infuse a flavorant and/or aromatic to the tobacco by incorporating the liquid along the spiral groove 44 of the elongated portion 42. As the flavorant and/or liquid aromatic travels down groove 44 by gravity, the liquid will eventually be incorporated into the tobacco adjacent the cigar puller 40. Again, repeated applications of the flavorant and/or aromatic can be accomplished to meet the desired taste of the user.

Figure 10:
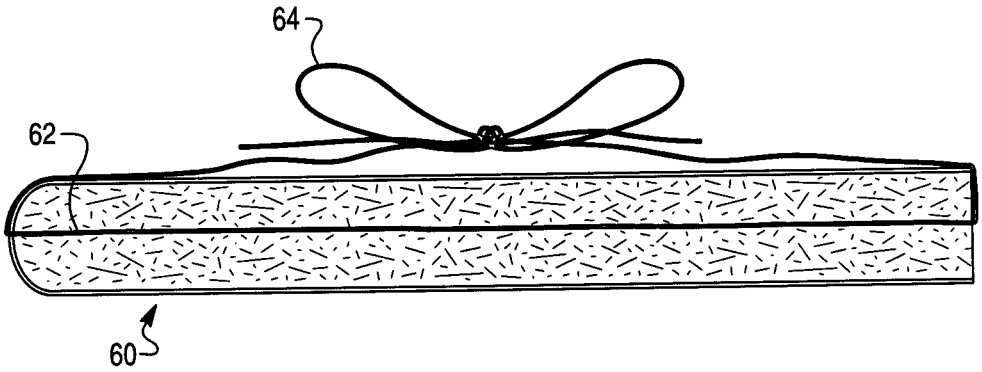
FIG. 10 is a longitudinal cross-section of still another embodiment of a cigar puller and infuser which can be used to incorporate flavorants and/or aromatic materials into the cigar.

An alternative cigar infuser is shown in FIG. 10. In this instance, the cigar 60 is provided with a string or yarn throughout which extends beyond both ends and can be tied together such that the string forms a continuous loop. In the embodiment shown in FIG. 10, the string 62 is tied at both ends to form a decorative bow 64. In this instance, a liquid can be applied to the string outside of the cigar and the string moved along the length of the cigar so as to bring that portion of the string which has been coated or impregnated with the flavorant and/or aromatic into the center of the cigar. If the ends of the string are not formed in a bow such as shown in FIG. 10, the string can be continuously circulated and the liquid infused throughout the length of the cigar. As shown in the embodiment of FIG. 10, the bow would likely have to be moved back and forth along the length of the cigar to eventually infuse the entire interior of the cigar with the desired flavorant/aromatic.

Although this embodiment is not shown, a cigar puller which has an elongated and variegated surface can be made of a porous material which will hold a chemical flavorant and/or aromatic. The porous cigar puller prior to incorporation into the cigar is treated with one or more flavorants and/or aromatics and then manufactured with the cigar as, for example, shown in FIG. 1. During storage of the cigar, the flavorant and/or aromatic can vaporize through the porous cigar puller and cause the tobacco within the cigar to be infused with the vaporized ingredient.

Figure 11:
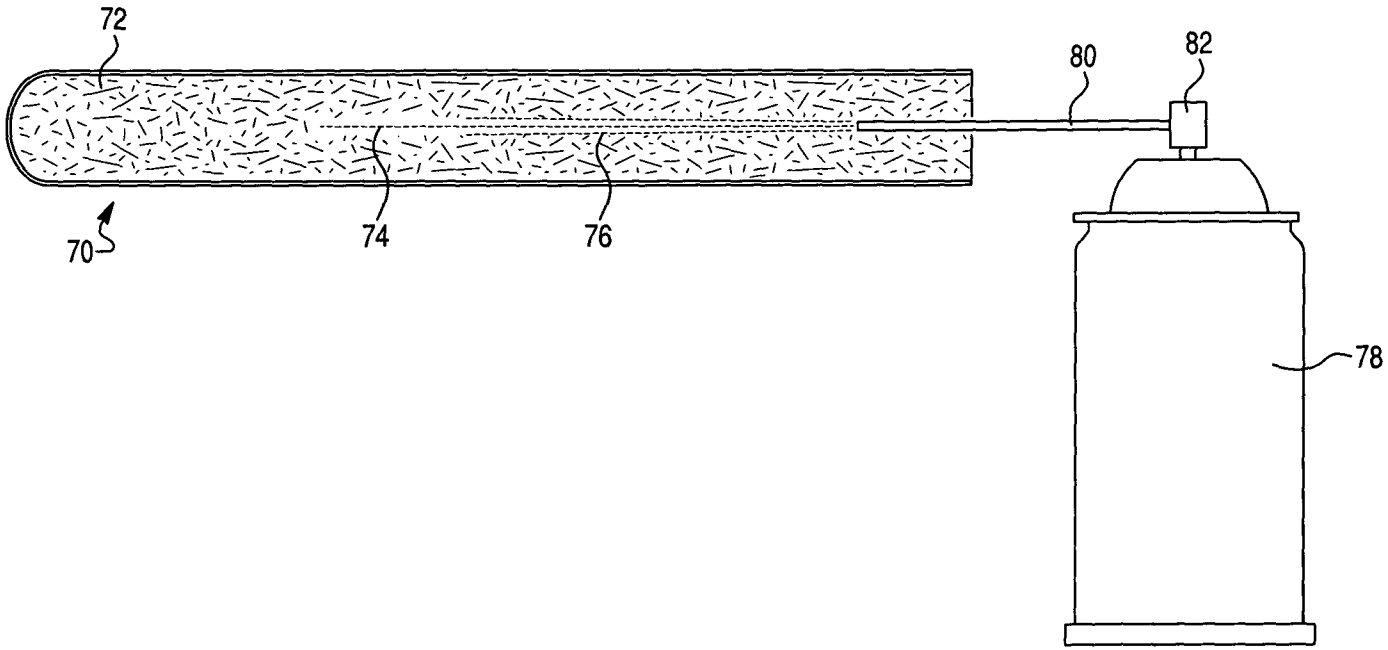
FIG. 11 is a drawing partly in cross-section illustrating an alternative method of infusing flavorants and/or aromatics into a cigar.

FIG. 11 illustrates still another method of infusing a flavorant and/or aromatic into the fill material of a cigar. As shown in FIG. 11, cigar 70 contains a tobacco fill material 72. In this instance, a cigar puller, such as those described previously, has been removed from the cigar to provide a channel 74 having a fill density less than the remaining portion of the tobacco fill material 72. A flavorant and/or aromatic in liquid, vapor, or solid form, such as in a consolidated form or fine powder, can then be dispensed into channel 74. In the embodiment shown in FIG. 11, an aerosol liquid 76 is dispensed from a container 78. As shown, the aerosol 76 is directed into channel 74 via a thin dispensing tube 80. The specific structure of container 78 is not part of the present invention and can be any supply of liquid, gas, or solid. Thus, container 78 can be a supply of a liquid, vapor, or powdered solid pressurized with an inert gas, or pressurized for dispensing by any well known pump dispenser structure broadly indicated by reference numeral 82. Other means of supplying the flavorant and/or aromatic can be used so long as the material can be dispensed within the channel 74 of less dense fill material.

Figure 12A:
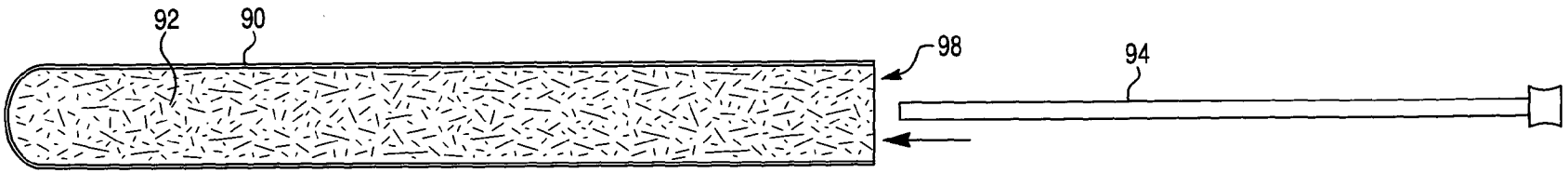
FIGS. 12A, 12B, 12C, and 12D are drawings partly in cross-section illustrating still another alternative method of infusing flavorants and/or aromatics into a cigar.
Figure 12B:
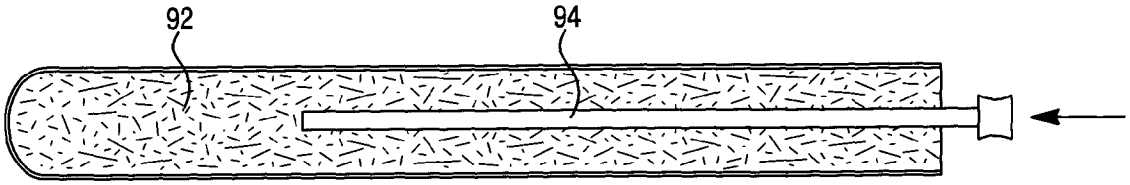
Figure 12C:
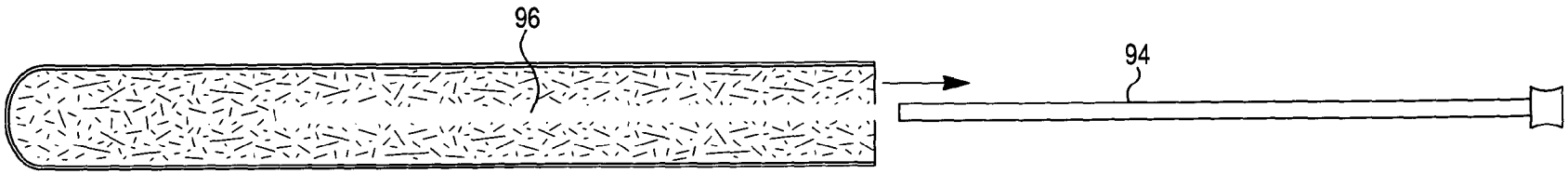
Figure 12D:
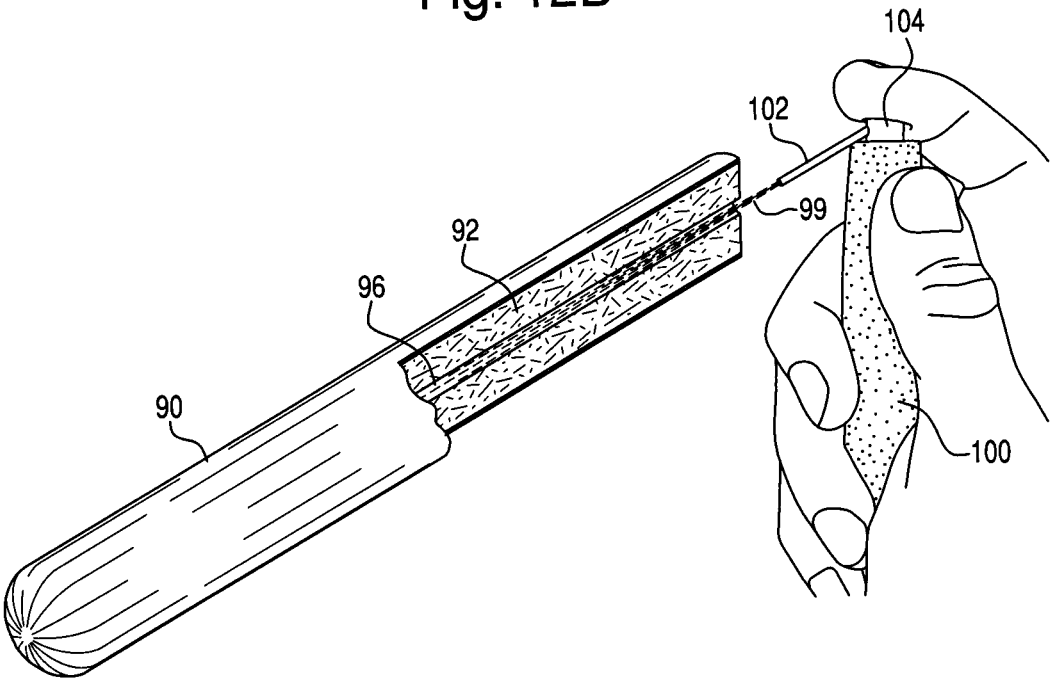

FIGS. 12A-12D represents still another method of infusing a cigar with flavorants and/or aromatic materials to enhance the smoking experience. FIG. 12A shows a cigar 90 containing a tobacco fill material 92. In this embodiment, a tobacco fill cutter 94, equivalent or similar to the cigar pullers as shown in FIGS. 1-4, is used to form a channel 96 of less dense fill material within tobacco fill material 92. Thus, as shown in FIGS. 12A, B and C, the tobacco cutter 94 is inserted into the open end 98 of cigar 90 and pushed through the tobacco fill material 92. Generally, the cutter 94 is pushed into the fill material 92 at least ¼ of the length of cigar 90. The cutter 94 can be pushed into fill material 92 at least ½ the length of cigar 90 or more. Withdrawal of the cutter 94 forms the channel 96 of less dense tobacco fill, as shown in FIG. 12C. Once the channel 96 of less dense fill material is formed, a flavorant and/or aromatic material in liquid, vapor, or solid form can be dispensed into channel 96 as previously described with respect to FIG. 11. As shown in FIG. 12D, the cigar 90 with a channel 96 of less dense fill material is infused with a flavorant and/or aromatic indicated by reference numeral 99 dispensed from a container 100 which includes a dispensing nozzle 102 and pump applicator 104. Container 100 can be a pocket-type applicator containing the flavorant and/or aromatic. Such applicators are well known in the art and have been used, for example, for breath sprays. Thus, the container 100 shown in FIG. 12D can be conveniently carried by the user and effectively used to enjoy the smoking experience and/or suckling effect without lighting the cigar. Again, any type of dispensing container can be used for container 100, and the exact nature of the supply and dispensing device is not part of the invention.

The particular flavorant and/or aromatic which is infused into the cigar is not a part of the present invention, and any and all such materials would be expected to have use in the present invention and be able to be applied by the processes described herein. Flavorants and/or aromatics may need to be carried by a particular solvent whether aqueous or organic so long as any carrier used is not toxic to the user and does not adversely affect the tobacco fill material. Such carrier may have a benefit in spreading the flavorant and/or aromatic throughout the interior of the cigar. In general, non-limiting examples of flavorants and aromatics comprise oils or extracts of various fruits or plants, i.e. orange, lemon, lavender, spearmint, vanilla, etc. Crystallized extracts can also be used. Such materials will have to be dissolved in a liquid, non-toxic carrier. As previously stated, flavorants and/or aromatics may be in the form of a fine powder such as many plant extracts and spices. Vaporized forms of the oils and extracts can also be used and added into the interior of the cigar through a hollow cigar puller device of this invention.

The preferred embodiment of the present invention is now fully described. The above description, however, is only illustrative of the invention and is not intended to limit the invention in spirit or scope. Only the following claims and their equivalents limit the scope of the invention.

I claim:

1. A method of infusing tobacco fill material contained within the interior of a cigar with a flavorant and/or aromatic material to alter the taste and/or aroma of said cigar, said cigar having an elongated cigar puller contained in the tobacco fill material during manufacturing, and which remains therein after manufacturing, said elongated cigar puller extending into said tobacco fill material from one end of said cigar, and not extending the full length of said cigar, comprising; removing said cigar puller from said cigar to form a channel of less dense tobacco fill material in said cigar, and subsequent to removing said puller adding a flavorant and/or aromatic material to said channel such that said flavorant and/or aromatic contacts the tobacco fill material.

2. The method of claim 1, wherein said flavorant or aromatic is a liquid, vapor, or solid.

3. The method of claim 2, wherein said flavorant or aromatic is a liquid.

4. The method of claim 3, wherein said liquid is in the form of an aerosol.

5. The method of claim 1, wherein said flavorant or aromatic is dispensed into said channel via a dispensing tube connected to a supply of said flavorant and/or aromatic.

6. The method of claim 1, wherein said elongated cigar puller extends at least ¼ of the length of said cigar into said tobacco fill material.

7. The method of claim 1, wherein said elongated cigar puller extends at least ½ of the length of said cigar into said tobacco fill material.

8. The method of claim 1, wherein said flavorant or aromatic is comprised of fruit oils, plant oils, or extracts.

9. The method of claim 1, wherein said flavorant or aromatic is a solid.

10. The method of claim 1, wherein said flavorant and/or aromatic material is provided from a pocket-size dispenser.

* * * * *